US007944671B2

(12) United States Patent
Nishida et al.

(10) Patent No.: US 7,944,671 B2
(45) Date of Patent: May 17, 2011

(54) CONTROL APPARATUS AND CONTROL METHOD OF ELECTROMAGNETIC DRIVE VALVE OPERATING MECHANISM

(75) Inventors: Hideyuki Nishida, Suntou-gun (JP); Mikio Yokota, Toyohashi (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 484 days.

(21) Appl. No.: 12/089,259

(22) PCT Filed: Oct. 5, 2006

(86) PCT No.: PCT/IB2006/002775

§ 371 (c)(1),
(2), (4) Date: Apr. 4, 2008

(87) PCT Pub. No.: WO2007/039803

PCT Pub. Date: Apr. 12, 2007

(65) Prior Publication Data

US 2008/0218930 A1 Sep. 11, 2008

(30) Foreign Application Priority Data

Oct. 5, 2005 (JP) ..... 2005-292810

(51) Int. Cl.
*H01H 47/00* (2006.01)
*F01L 1/34* (2006.01)

(52) U.S. Cl. ..... 361/152; 361/139; 123/90.17

(58) Field of Classification Search ..... 361/152, 361/139; 123/90.17
See application file for complete search history.

(56) References Cited

U.S. PATENT DOCUMENTS

| | | | | |
|---|---|---|---|---|
| 4,942,854 | A * | 7/1990 | Shirai et al. | 123/90.17 |
| 5,379,737 | A * | 1/1995 | Hu | 123/322 |
| 5,742,467 | A * | 4/1998 | Schmitz | 361/154 |
| 6,661,636 | B2 * | 12/2003 | Koch | 361/154 |
| 6,732,687 | B2 * | 5/2004 | Djordjevic | 123/90.16 |
| 2002/0112682 | A1 | 8/2002 | Koch | |

FOREIGN PATENT DOCUMENTS

| | | |
|---|---|---|
| DE | 37 33 704 | 4/1988 |
| DE | 195 31 437 | 2/1997 |
| DE | 198 32 198 | 1/2000 |
| DE | 199 47 848 | 5/2000 |
| DE | 198 60 197 | 6/2000 |
| DE | 102 06 031 | 9/2003 |

(Continued)

*Primary Examiner* — Stephen W Jackson
*Assistant Examiner* — Zeev Kitov
(74) *Attorney, Agent, or Firm* — Oblon, Spivak, McClelland, Maier & Neustadt, L.L.P.

(57) ABSTRACT

When a target valve timing determined in accordance with the state of operation of an internal combustion engine is acquired, a feed forward control of setting a command timing of a valve body on the basis of the target valve timing and a predicted delay time is performed, and a feedback control of setting the actual delay time in the previous cycle as a predicted delay time for the next cycle is performed. The valve timings (opening, closure) are specified at a timing at which the valve body reached a position that is apart from a predetermined position on a basis of a buffer height of a buffer mechanism. This makes it to possible to accurately detect the actual delay time in the feedback control, and allows the command timing to be properly set in the feed forward control.

4 Claims, 11 Drawing Sheets

FOREIGN PATENT DOCUMENTS

| | | |
|---|---|---|
| JP | 2001 193504 | 7/2001 |
| JP | 2002 266667 | 9/2002 |
| JP | 2003-322033 | 11/2003 |
| JP | 2004 11852 | 1/2004 |
| JP | 2004-76706 | 3/2004 |
| WO | 01 20140 | 3/2001 |

* cited by examiner

CONTROL APPARATUS AND CONTROL METHOD OF ELECTROMAGNETIC DRIVE VALVE OPERATING MECHANISM

BACKGROUND OF THE INVENTION

1. Field of the Invention

The invention relates to a control apparatus of an electromagnetic drive valve operating mechanism that opens and closes intake valves and exhaust valves used in an internal combustion engine through cooperation of electromagnetic force and elastic force.

2. Description of the Related Art

There exists an electromagnetic drive valve operating mechanism in which an armature is fixed to the stem of a valve, and each one of two opposite sides of the armature in the direction of an axis of the stem is provided with one electromagnet that is coaxial with the stem. In this mechanism, when the upper and lower electromagnets are in a non-driven state, the armature is positioned at a neutral position by upper and lower springs. By causing the armature to be attracted and attached to the upper-side electromagnet, the valve body is disposed at a fully closed position. Furthermore, by causing the armature to be attracted and attached to the lower-side electromagnet, the valve body is disposed at a fully open position (e.g., see Japanese Patent Application Publication No. JP-A-2002-266667, and Japanese Patent Application Publication No. JP-A-2001-193504).

As for the actions, by alternately controlling the supply and the stop of the exciting current with respect to the upper and lower electromagnets at a timing that is in accordance with the need, a movable portion that includes the armature and the valve body is displaced in the direction of the axis so that the valve is opened or closed.

In the case of an electromagnetic drive valve operating mechanism as described above, when the valve body is to be opened or closed, the supply of the hold current supplied to the electromagnet is stopped in order to separate the valve body attracted and attached to the electromagnet. However, since a time is needed between the stop of supply of the hold current and the disappearance of the residual electromagnetic force that remains in the electromagnet, a response delay (delay time) before the valve body actually begins to open or close occurs.

Therefore, this delay time is predicted, and a feed forward control is preformed in such a direction as to advance the command timing for starting the opening/closing action of the valve body. The predicted delay time is a fixed value that is empirically determined as a constant through experiments or the like.

In the foregoing electromagnetic drive valve operating mechanism, there are matters for improvement in the following respects.

That is, the residual electromagnetic force of each electromagnet used in the electromagnetic drive valve operating mechanism varies due to individual differences of the electromagnets used, so that the response delay may vary. This response delay may vary also depending on the operation situation (rotation speed, load, or the like) of an internal combustion engine. Therefore, if the predicted delay time for use in the feed forward control is a fixed value as in the above-described electromagnetic drive valve operating mechanism, it can be said that variations in the response delay cannot be absorbed.

Furthermore, to set fixed values as the predicted delay time, many actual delay times are measured in experiments. However, since the measurement end timing, that is, the position at which the valve body actually begins to open or finishes closing, cannot be accurately detected, it can be said that the predicted delay time cannot be accurately set.

The measurement end timing (timing at which the valve body actually begins to open or finishes closing) is judged on the basis of the output of a lift sensor. The timing at which the valve body actually begins to open is defined as a position of the valve body that is very slightly apart from the fully closed position, while the timing at which the valve body actually finishes closing is defined as a position of the valve body that is limitlessly adjacent to the fully closed position. Since there is a need to detect these positions by the output of the lift sensor, noise contamination of the output of the lift sensor, if any occurs, will make it extremely difficult to discriminate the lift position of a very small amount and noise.

Therefore, it can be said that the discrimination of the measurement end timing includes an error. If the fixed value as the predicted delay time is determined on the basis of a result of measurement with such a large error, it has to be said that the correctness of the fixed value is low.

Thus, since variations in individual differences of electromagnets cannot be absorbed and, furthermore, since the predicted delay time is set at a fixed value whose correctness is low, the possibility of the actual valve timing deviating from a target valve timing is considered to be high. Occurrence of such a deviation leads to torque fluctuations of the internal combustion engine, such as deviation of the combustion condition of the internal combustion engine from a proper range, etc., and is therefore not preferable.

It is conceivable that after the above-described feed forward control, a feedback control is performed in which an actual delay time is detected in association with the actual action of the valve body and a result of detection is used to correct the fixed value. However, if at the time of the detection, the measurement end timing of the actual valve body is set at the timing at which the valve body actually begins to open or finishes closing, it can be said that the correctness of a result of measurement of the actual delay time becomes low as in the foregoing case.

SUMMARY OF THE INVENTION

It is an object of the invention to restrain or prevent deviation of an actual valve timing relative to a target valve timing in a control apparatus of an electromagnetic drive valve operating mechanism for use in an internal combustion engine, and improve the combustion condition of the internal combustion engine.

A first aspect of the invention relates to a control apparatus of an electromagnetic drive valve operating mechanism that opens and closes a valve body used as an intake valve or an exhaust valve of an internal combustion engine through coordination of electromagnetic force and elastic force. This control apparatus of the electromagnetic drive valve operating mechanism is characterized in that the valve body has an upper-part stem provided with an armature that is pulled by the electromagnetic force, a lower-part stem provided downward from the upper-part stem in a direction of opening/closing action of the valve body, and a buffer mechanism provided between the upper-part stem and the lower-part stem, and that the control apparatus comprises: setting means for setting, as a valve timing, a timing at which the valve body reached a position that is apart from a predetermined position on a basis of a buffer height of the buffer mechanism; storage means in which a predetermined value obtained by determining, as a constant that is termed predicted delay time, a time that was needed for the valve body to be displaced from a command timing for designating an opening/closure start of the valve body to a target valve timing, and a correction value for correcting the predetermined value are stored; command timing setting means for setting, when a target valve timing determined in accordance with a state of operation of the internal combustion engine is acquired, the command timing by reading out the predetermined value and the correction value from the storage means and subtracting a sum of the predetermined value and the correction value from the target valve timing; and correction means for determining, when the set valve timing is detected by lifting the valve body through a control of the electromagnetic force in accordance with the set command timing, a deviation of the detected actual valve timing relative to the target valve timing, and updating the correction value in the storage means on a basis of a value of the deviation.

In this constitution, the valve timing is specified at a position that is accurately detectable by a lift sensor or the like. Therefore, when the actual valve timing deviation is to be determined, or at the time of measurement by the lift sensor or the like in an experimental stage for determining as constants the predetermined values to be stored in the storage means, the measurement end timing can be accurately specified. Besides, the actual valve timing can be accurately detected via the correction means. Therefore, it becomes less likely that errors will be included in the deviation and the predetermined values.

Furthermore, since the actual deviations of the valve timings acquired in the previous cycle are successively stored as updates of the correction values in the storage means, the correctness of the predicted delay times for use at the time of setting the command timings improves, and it becomes possible to properly set the command timings.

Therefore, it becomes possible to restrain or prevent deviation between the actual valve timings and the target valve timings in an early stage from the startup of the internal combustion engine. Consequently, the combustion condition of the internal combustion engine can be brought into a proper range promptly after the engine is started. Hence, it becomes possible to restrain or prevent torque fluctuations of the internal combustion engine.

Incidentally, where the predicted delay time is corrected in every cycle as in the foregoing construction, the greater the value of the deviations, the earlier the command timings in the next cycle tend to be.

A second aspect of the invention relates to a control apparatus of an electromagnetic drive valve operating mechanism that opens and closes a valve body used as an intake valve or an exhaust valve of an internal combustion engine through coordination of electromagnetic force and elastic force. This control apparatus of the electromagnetic drive valve operating mechanism is characterized in that the valve body has an upper-part stem provided with an armature that is pulled by the electromagnetic force, a lower-part stem provided downward from the upper-part stem in a direction of opening/closing action of the valve body, and a buffer mechanism provided between the upper-part stem and the lower-part stem, and that the control apparatus comprises: setting means for setting, as a valve timing, a timing at which the valve body reached a position that is apart from a predetermined position on a basis of a buffer height of the buffer mechanism; storage means in which a predetermined value obtained by determining, as a constant that is termed predicted delay time, a time that was needed for the valve body to be displaced from a command timing for designating an opening/closure start of the valve body to a target valve timing is stored; command timing setting means for setting, when a target valve timing determined in accordance with a state of operation of the internal combustion engine is acquired, the command timing by reading out the predetermined value from the storage means and subtracting the predetermined value from the target valve timing; and correction means for determining, when the set valve timing is detected by lifting the valve body through a control of the electromagnetic force in accordance with the set command timing, an actual delay time from command timing till the actual valve timing, and updating the predetermined value in the storage means on a basis of the actual delay time.

In this constitution, the valve timing is specified at a position that is accurately detectable by a lift sensor or the like. Therefore, when the actual delay time is to be determined, or at the time of measurement by the lift sensor or the like in an experimental stage for determining as constants the predetermined values of predicted delay times to be stored in the storage means, the measurement end timing can be accurately specified. Besides, the actual valve timing can be accurately detected via the correction means. Therefore, it becomes less likely that errors will be included in the actual delay times to be detected and the predetermined values of predicted delay times.

Furthermore, since the actual delay times accurately acquired in the previous cycle are successively stored as updates of the predetermined values of predicted delay times in the storage means, the correctness of the predicted delay times for use at the time of setting the command timings improves, and it becomes possible to properly set the command timings.

Therefore, it becomes possible to restrain or prevent deviations between the actual valve timings and the target valve timings in an early stage from the startup of the internal combustion engine. Consequently, the combustion condition of the internal combustion engine can be brought into a proper range promptly after the engine is started. Hence, it becomes possible to restrain or prevent torque fluctuations of the internal combustion engine.

In the above-described control apparatus of the electromagnetic drive valve operating mechanism, the buffer height may be a value determined on a basis of an amount that the valve body is displaced at a constant speed relative to the fully closed position because of the buffer mechanism.

In this construction, the position of the valve timing is made clear by the aforementioned setting matters. Therefore, it becomes possible to accurately detect the valve timing via a lift sensor or the like without confusing it with external disturbances or the like, and it becomes possible to accurately perform various measurements related to the valve timing.

In the above-described control apparatus of the electromagnetic drive valve operating mechanism, when an actual valve timing is to be detected via the correction means, the crank angle occurring when the valve body arrives at the position that is apart from the fully closed position in correspondence to the buffer height may be read in, and this crank angle may be regarded as an actual valve timing.

In the above-described control apparatus of the electromagnetic drive valve operating mechanism, when detecting an actual delay time or a deviation as mentioned above, the correction means may determine the transition speed of the valve body between the opening valve timing and the closing valve timing, and may perform a process of detecting the actual delay time or the deviation if the transition speed is less than or equal to a threshold value.

In this construction, .the actual delay time or the deviation is detected when the transition speed is slow, that is, when the amount of displacement of the valve body is small. Therefore, for example, in the case of an intake valve, the intake valve will less likely be affected by intake air, so that the detection accuracy of the actual delay time will improve.

In the above-described control apparatus of the electromagnetic drive valve operating mechanism may further comprise: delay time map creation means for storing a predicted delay time for use by the command timing setting means, into a corresponding region in a delay time map in which a rotation speed and a load of the internal combustion engine are used as parameters; and management means for acquiring, at a timing at which the command timing setting means acquires a target valve timing, the rotation speed and the load of the internal combustion engine related to the target valve timing, and for reading out a predicted delay time from a pertinent region in the delay time map in correspondence to the acquired rotation speed and the acquired load, and for setting the read-out predicted delay time as a predetermined value for use at a time of setting a command valve timing during a next trip period.

Incidentally, the trip period means a period from the startup of operation of the internal combustion engine until it stops.

According to this construction, it becomes possible to shorten the time of convergence of the valve timing deviation in each region in correspondence to the fluctuations in the actual delay times in accordance with the fluctuations in the rotation speed and the load of the internal combustion engine. Therefore, the control apparatus of the invention becomes advantageous in restraining or preventing deterioration of emissions or fuel economy, or decline of torque, etc., in the internal combustion engine.

In the above-described control apparatus of the electromagnetic drive valve operating mechanism, the electromagnetic drive valve operating mechanism may have a plurality of valve bodies, and the predetermined value as a predicted delay time regarding each valve body may be individually stored in the storage means, and a process by the command timing setting means and the correction means may be performed individually for each valve body.

In this construction, in the electromagnetic drive valve operating mechanism having a plurality of valve bodies, the command timings for the opening/closing actions of the valve bodies are individually set. Therefore, even if there are variations in the electromagnetic force for driving the valve bodies, it is possible to absorb the variations and therefore properly set the command timing for each valve body. Therefore, the control apparatus is advantageous in uniforming the combustion conditions of the individual cylinders of the internal combustion engine.

In the above-described control apparatus of the electromagnetic drive valve operating mechanism according having a plurality of valve bodies may further comprise: delay time map creation means for individually storing a predicted delay time for use by the command timing setting means for each valve body, into a corresponding region in a delay time map for each valve body in which a rotation speed and a load of the internal combustion engine are used as parameters; and management means for individually acquiring, at a timing at which the command timing setting means for each valve body acquires a target valve timing, the rotation speed and the load of the internal combustion engine related to the target valve timing for each valve body, and for individually reading out a predicted delay time from a pertinent region in the delay time map for each valve body in correspondence to the acquired rotation speed and the acquired load, and for individually setting the read-out predicted delay time for each valve body as a predetermined value of the predicted delay time for use at a time of setting a command valve timing for each valve body during a next trip period.

This construction is provided on the assumption of the control apparatus that, in an electromagnetic drive valve operating mechanism having a plurality of valve bodies, individually sets the command timing of the opening/closing actions of each valve body, and secures delay time maps for each of the plurality of valve bodies. Therefore, even if there are variations in the electromagnetic force for driving the valve bodies, it is possible to absorb the variations of all the valve bodies so that the valve timings of the valve bodies can be individually made proper.

The above-described control apparatus of the electromagnetic drive valve operating mechanism having a plurality of valve bodies may further comprise abnormality diagnosis means for checking whether any one of all predicted delay times stored in mutually corresponding regions in the delay time maps for each valve body at predetermined timings is greater than or equal to a predetermined value, and for determining, if a predicted delay time is greater than or equal to the predetermined value, that an action of a pertinent valve body is abnormal.

This construction is provided on the assumption of an electromagnetic drive valve operating mechanism having a plurality of valve bodies, and makes it possible to estimate the presence/absence of occurrence of abnormality with regard to all the valve bodies. Therefore, the driver can be informed of the presence of an abnormality before a critical failure occurs, and an abnormality can be dealt with in an early stage, for example, by checking, repair, or the like.

Furthermore, it is not that information is acquired specifically for the abnormality diagnosis, but the predicted delay times accumulated as the delay time maps in the course of the valve timing control are used to perform the abnormality diagnosis. Therefore, this feature is advantageous in that unessential cost increase can be restrained.

A third aspect of the invention relates to a control method of an electromagnetic drive valve operating mechanism that opens and closes a valve body used as an intake valve or an exhaust valve of an internal combustion engine through coordination of electromagnetic force and elastic force. This control method of the electromagnetic drive valve operating mechanism comprises: the valve body having an upper-part stem provided with an armature that is pulled by the electromagnetic force, a lower-part stem provided downward from the upper-part stem in a direction of opening/closing action of the valve body, and a buffer mechanism provided between the upper-part stem and the lower-part stem; setting, as a valve timing, a timing at which the valve body reached a position that is apart from a predetermined position on a basis of a buffer height of the buffer mechanism; storing a predetermined value obtained by determining, as a constant that is termed predicted delay time, a time that was needed for the valve body to be displaced from a command timing for designating an opening/closure start of the valve body to a target valve timing, and a correction value for correcting the predetermined value; setting, when a target valve timing determined in accordance with a state of operation of the internal combustion engine is acquired, the command timing by reading out the predetermined value and the correction value from the storage means and subtracting a sum of the predetermined value and the correction value from the target valve timing; and determining, when the set valve timing is detected by lifting the valve body through a control of the electromagnetic force in accordance with the set command timing, a deviation of the detected actual valve timing relative to the target valve timing, and updating the correction value on a basis of a value of the deviation.

Therefore, the invention makes it possible to restrain or prevent deviation of the actual valve timing relative to the target valve timing, and is advantageous in improving the combustion condition of the internal combustion engine.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein:

FIG. 9 is a flowchart for describing a delay time map creating routine in the valve timing control in another embodiment of the control apparatus in accordance with the invention;

DETAILED DESCRIPTION OF THE PREFERRED EMBODIMENTS

Hereinafter, embodiments of the invention will be described in detail with reference to the drawings. FIGS. 1 to 8 show an embodiment of the invention.

Figure 1:
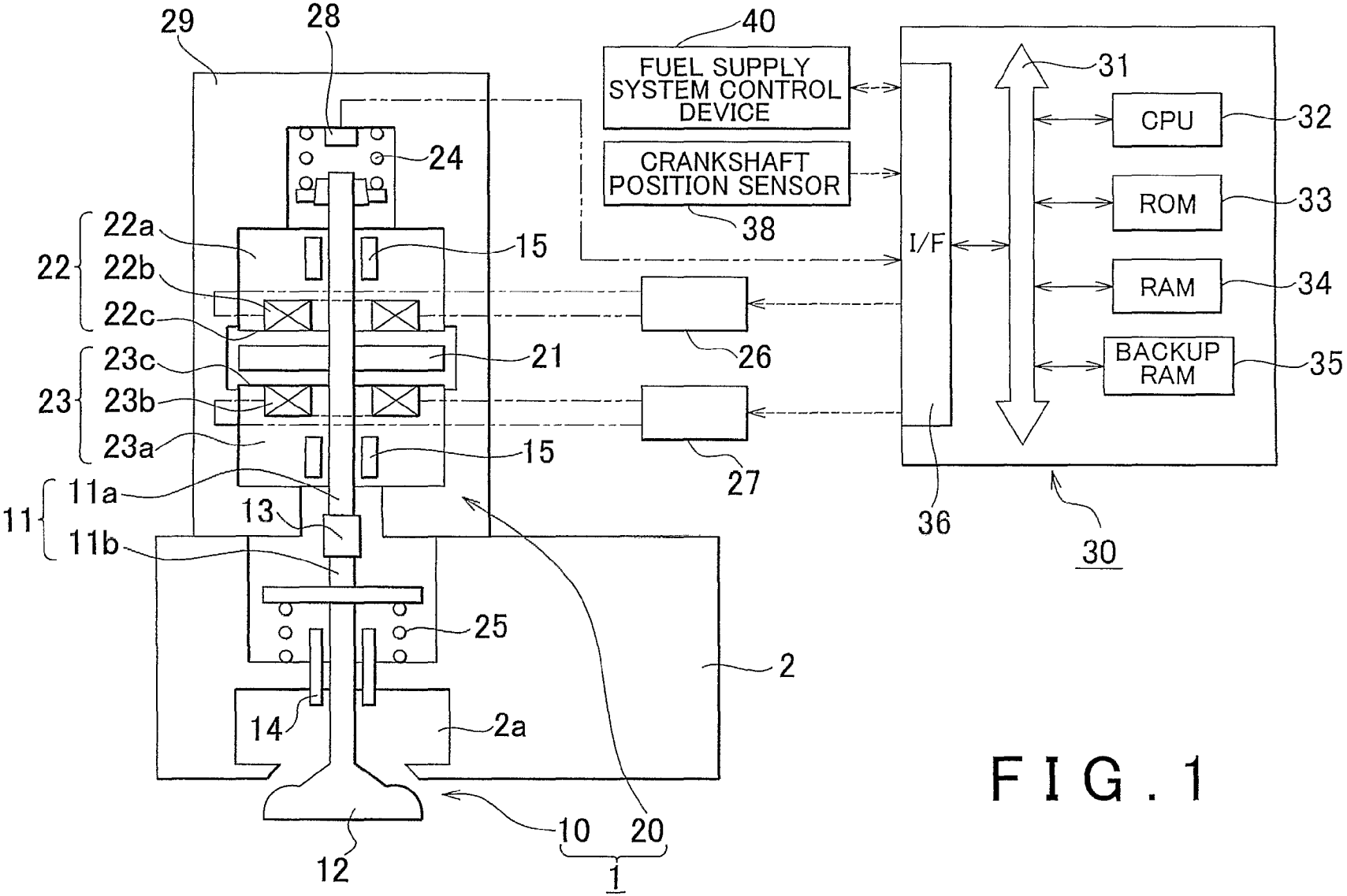
FIG. 1 shows a conceptual diagram showing an embodiment of a control apparatus of an electromagnetic drive valve operating mechanism in accordance with the invention, and a sectional view of the electromagnetic drive valve operating mechanism showing a neutral state of a valve body.

FIG. 1 shows an electromagnetic drive valve operating mechanism for use in an internal combustion engine (a gasoline engine, a diesel engine, etc.) that is mounted in a vehicle such as a motor vehicle or the like.

An example electromagnetic drive valve operating mechanism 1 shown in the figures has, for example, a structure called translational drive type, and includes a valve body 10 used as an intake valve, an exhaust valve or the like which is mounted on a cylinder head 2, and a drive portion 20 that actuates the valve body 10.

In the valve body 10, a bell portion 12 is integrally provided on an end of a stem 11 that is a shaft portion. The valve body 10 is displaced back and forth in the direction of the axis so that the bell portion 12 opens and closes an intake port 2*a* of the cylinder head 2. That is, when the valve body 10 descends, the bell portion 12 opens an intake port 2*a*. On the other hand, when the valve body 10 ascends, the bell portion 12 closes the intake port 2*a*.

The stem 11 is constructed of a lower-part stem 11*b* that extends from the bell portion 12, and an upper-part stem 11*a* that is coupled to an upper end of the lower-part stem 11*b* via a lash adjuster 13 so as to form a straight-line configuration. The lower-part stem 11*b* is freely slidably guided by a valve guide 14 that is provided on the cylinder head 2. The upper-part stem 11*a* is freely slidably guided by stem guides 15 that are provided in upper and lower electromagnets 22, 23. Incidentally, the lash adjuster 13 functions as a buffer mechanism between the upper-part stem 11*a* and the lower-part stem 11*b*, and has a characteristic of being easily expandable but less easily contractible.

The drive portion 20 displaces the valve body 10 in a reciprocating fashion in the direction of an axis through the coordination of electromagnetic force and elastic force. The drive portion 20 includes one armature 21, two electromagnets, that is, an upper electromagnet 22 and a lower electromagnet 23, an upper-side elastic member 24 for opening the valve and a lower-side elastic member 25 for closing the valve, two drive circuits 26, 27, and a lift sensor 28.

The armature 21 is made of an annular that is formed from, for example, a soft magnetic material or the like, and is fitted and fixed to an outside of an intermediate portion of the upper-part stem 11*a* in the direction of the axis.

The upper and lower electromagnets 22, 23 are fixed to a base 29 so that they are disposed at the upper and lower sides of the armature 21, respectively, with a predetermined air gap. Each of the electromagnets 22, 23 generates electromagnetic force for pulling the armature 21 in accordance with need.

Each electromagnet 22, 23 is composed of a core 22*a*, 23*a* made of a magnetic material, and a coil 22*b*, 23*b*.

Each core 22*a*, 23*a* is formed to have a cylindrical shape, and is fixed to an inner periphery of the base 29. Each coil 22*b*, 23*b* is housed in an annular groove that is open on a side surface of the core 22*a*, 23*a*. The two ends of each coil 22*b*, 23*b* are connected to a corresponding one of drive circuits 26, 27. When a predetermined exciting current I is supplied to the coil 22*b*, 23*b* via the drive circuit 26, 27, a lower surface of the upper-side core 22*a* becomes a valve-closing attracting surface 22*c* that generates electromagnetic force for pulling the armature 21 upward, and an upper surface of the lower-side core 23*a* becomes a valve-opening attracting surface 23*c* that generates electromagnetic force for pulling the armature 21 downward.

Upper and lower elastic members 24, 25 are each made of, for example, a cylindrical coil spring. The upper and lower elastic members 24, 25 which generate elastic forces (have spring constants) that are opposite in direction and balance with each other so as to dispose the armature 21 and the valve body 10 at a neutral position have been selected.

The upper-side elastic member 24 is disposed in a compressed state between an end flange of the upper-part stem 11*a* of the valve body 10 and an upper surface of the base 29, and generates elastic force (elastic restoration force) that elastically urges the valve body 10 downward, that is, in the valve-opening direction. The lower-side elastic member 25 is disposed in a compressed state between an intermediate portion of the lower-part stem 11*b* of the valve body 10 and a recess bottom surface of the cylinder head 2, and generates elastic force (elastic restoration force) that elastically urges the valve body 10 upward, that is, in the valve-closing direction.

The drive circuits 26, 27 supplys a required magnitude of exciting current I to the electromagnets 22, 23, respectively, in accordance with an open/close command timing input from the engine control apparatus 30.

The lift sensor 28 is provided on an inner surface of an upper portion of the base 29, facing the end flange of the upper-part stem 11*a*. The lift sensor 28 detects the amount of displacement of the upper-part stem 11*a* of the valve body 10 in the upward and downward directions from its neutral position. The lift sensor 28 is, for example, a sensor that outputs an electrical signal that corresponds to the amount of displacement of the upper-part stem 11*a* of the valve body 10 detected optically in the direction of the axis, but is not particularly limited.

The drive portion 20 constructed as described above is controlled by the engine control apparatus 30. The engine control apparatus 30 is made of, for example, an ECU (Electronic Control Unit) that is generally known to public, and is equipped with a CPU 32, a ROM 33, a RAM 34, a backup RAM 35 and an interface 36 that are interconnected by a bidirectional bus 31.

Incidentally, the CPU 32 receives at least the inputs of output signals of various sensors, such as a valve lift sensor 28, a crank position sensor 38, etc., and the input of information indicating a target valve timing of the valve body 10 determined in accordance with the state of operation of the internal combustion engine from a fuel supply system control apparatus (e.g., an EFIECU) 40 at an appropriate timing.

The ROM 33 stores at least programs related to a valve timing control for controlling the opening/closing action of the valve body 10 in accordance with the state of operation of the internal combustion engine, and the like. The RAM 34 is a memory that temporarily stores results of computations performed by the CPU 31, data or the like input from the various sensors, etc. The backup RAM 35 is a non-volatile memory that stores various data that needs to be saved.

First, basic actions regarding the valve timing control by the engine control apparatus 30 will be described with reference to FIGS. 4A, 4B and 4C.

Figures 4A, 4B, 4C:
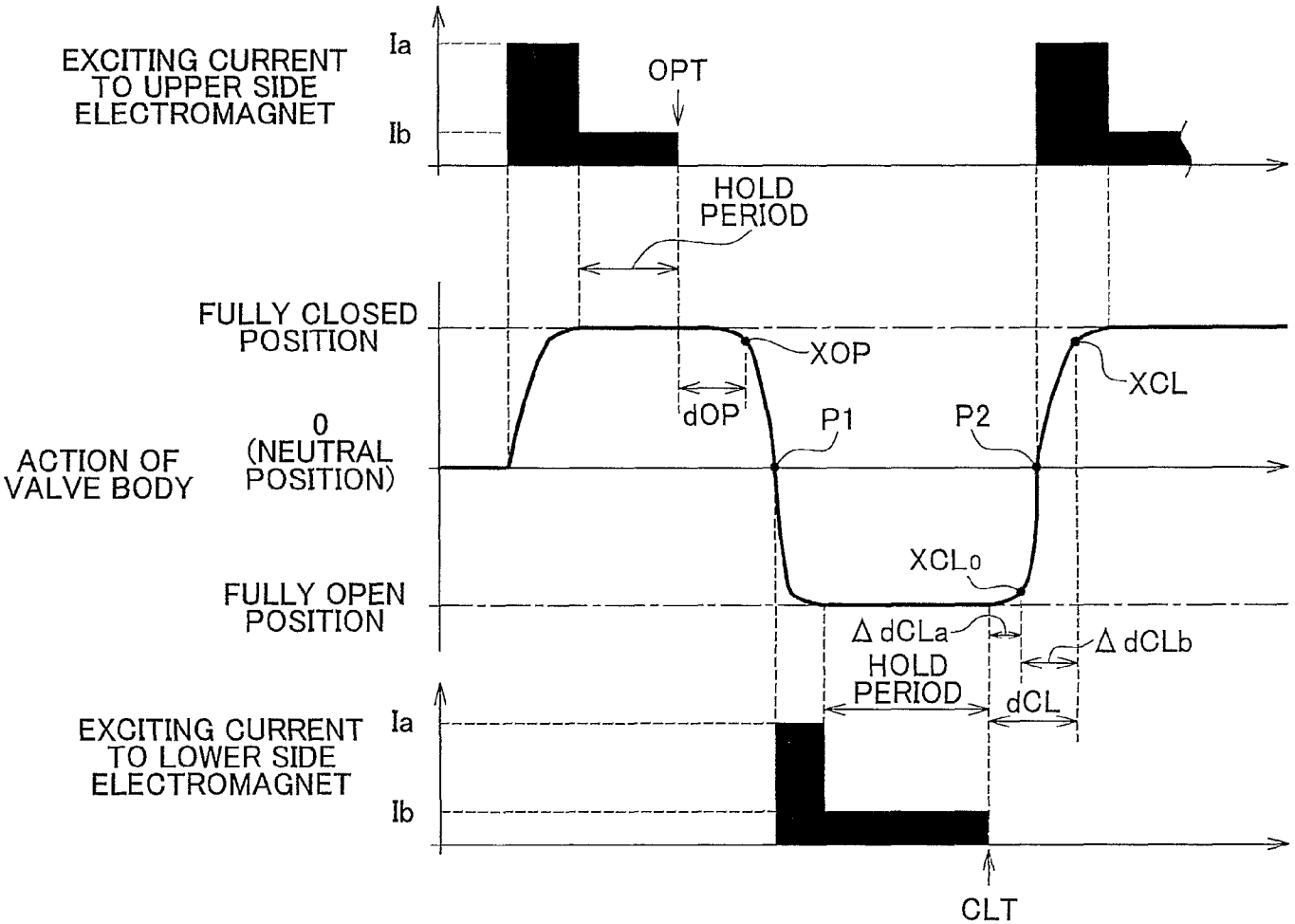
FIGS. 4A, 4B and 4C are timing charts showing a valve timing control in accordance with the embodiment shown in FIG. 1.

During a state where exciting current is not supplied to the upper or lower electromagnet 22, 23, the armature 21 and the valve body 10 are at rest at the neutral position by the elastic forces of the upper and lower elastic members 24, 25 as shown in FIG. 1 and FIG. 4B.

<Initial Drive Action>

When there is an initial drive request, that is, when the internal combustion engine is put into a startup-enabled state, for example, upon operation of an ignition switch, the valve body 10 is displaced to, for example, a fully closed position, as an initial position.

Figure 2:
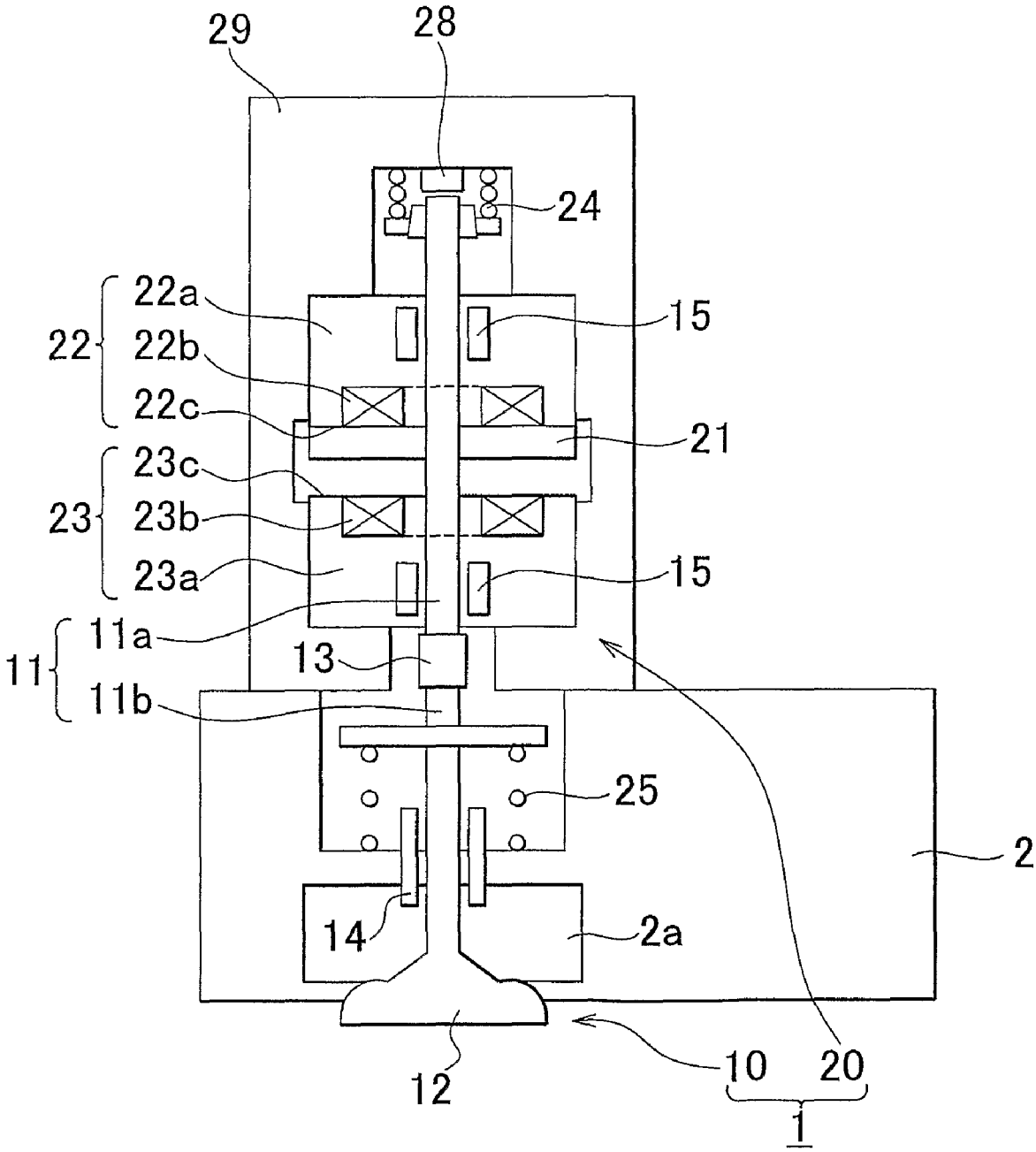
FIG. 2 is a sectional view of the electromagnetic drive valve operating mechanism, showing a state where the valve body is fully closed from the state of FIG. 1.

That is, as shown in FIG. 4A, a first current Ia of a predetermined magnitude is supplied only to the coil 22*b* of the upper-side electromagnet 22. The coil 23*b* of the lower-side electromagnet 23 is not supplied with exciting current. Therefore, due to the electromagnetic force generated from the valve-closing attracting surface 22*c* of the upper-side electromagnet 22, the armature 21 and the valve body 10 are displaced upward as shown in FIG. 2. Incidentally, the first current Ia is, for example, a current that causes the upper-side electromagnet 22 to generate an electromagnetic force that is needed in order to pull the valve body 10 to the fully closed position against the elastic force of the upper-side elastic member 25.

When the armature 21 is attracted and attached to the valve-closing attracting surface 22*c* and therefore the valve body 10 reaches the fully closed position, the exciting current I supplied to the coil 22*b* of the upper-side electromagnet 22 is altered to a hold current Ib that is smaller than the first current Ia as shown in FIG. 4A. Therefore, as the state where the armature 21 is attached to the valve-closing attracting surface 22*c* is held, the valve body 10 is held at the fully closed position as shown in FIG. 2. At this time, the upper-side elastic member 24 assumes a most compressed state, and the lower-side elastic member 25 assumes a most expanded state. Incidentally, the arrival of the valve body 10 at the fully closed position can be detected on the basis of the output of the lift sensor 28.

<Switching Action from Full Closure to Full Opening>

Figure 3:
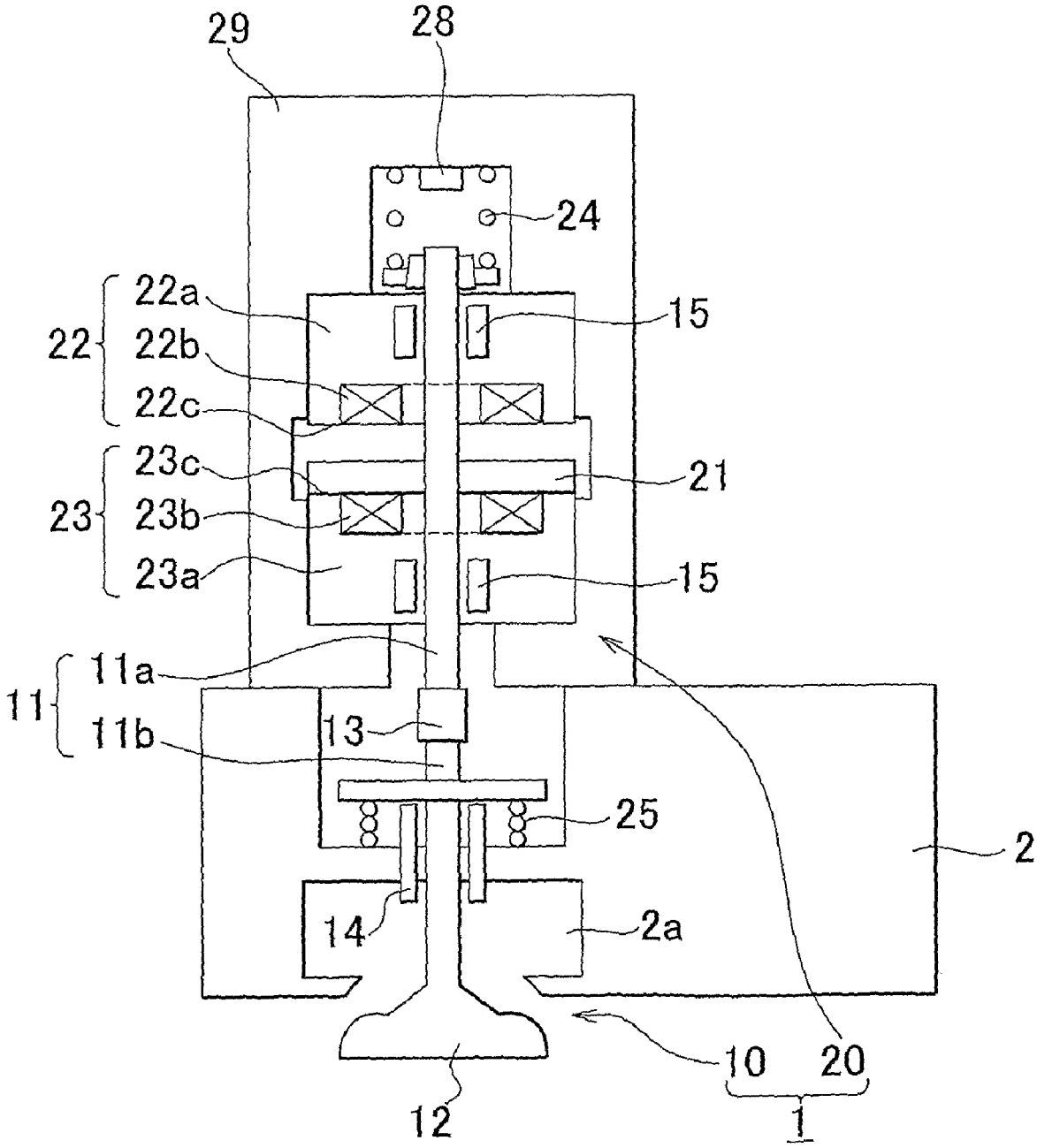
FIG. 3 is a sectional view of the electromagnetic drive valve operating mechanism, showing a state where the valve body is fully open from the state of FIG. 1.

To displace the valve body 10 to the fully open position as shown in FIG. 3 after the initial driving as described above, the present supply of the hold current Ib to the coil 22*b* of the upper-side electromagnet 22 is stopped as shown in FIG. 4A. Therefore, as the electromagnetic force generated on the valve closure-side attracting surface 22*c* of the upper-side electromagnet 22 disappears, the elastic restoration force of the upper-side elastic member 24 being in the most compressed state displaces the armature 21 and the valve body 10 downward.

When the thus-descending valve body 10 arrives near the neutral position (zero cross point P1) as shown in FIG. 4B, the first current Ia is supplied to the coil 23*b* of the lower-side electromagnet 23 as shown in FIG. 4C. Therefore, the armature 21 is attracted downward by the electromagnetic force generated from the valve-opening attracting surface 23*c* of the lower-side electromagnet 23. On the other hand, the elastic restoration force of the upper-side elastic member 24 disappears, but there is an inertia force acting on the armature 21 and the valve body 10 which have been descending due to the elastic restoration force. Therefore, the resultant force of the inertia force and the attraction force due to the electromagnetic force further displaces the armature 21 and the valve body 10 downward until finally the armature 21 is attached to the valve-opening attracting surface 23*c* of the lower-side electromagnet 23 and the valve body 10 reaches the fully open position as shown in FIG. 4B. Incidentally, the arrival of the valve body 10 at the fully open position can be detected on the basis of the output of the lift sensor 28.

When the armature 21 is attached to the valve-opening attracting surface 23*c* as described above, the exciting current I supplied to the coil 23*b* of the lower-side electromagnet 23 is altered to the hold current Ib that is smaller than the first current Ia, as shown in FIG. 4C. Therefore, as the state where the armature 21 is attached to the valve-opening attracting surface 23*c* is held, the valve body 10 is held at the fully open position. At this time, the upper-side elastic member 24 assumes a most expanded state, and the lower-side elastic member 25 assumes a most compressed state.

<Switching Action from Full Opening to Full Closure>

To displace the valve body 10 disposed at the fully open position as described above to the fully closed position as shown in FIG. 2, the present supply of the hold current Ib to the coil 23*b* of the lower-side electromagnet 23 is stopped as shown in FIG. 4C. Therefore, as the electromagnetic force generated on the valve-opening attracting surface 23*c* of the lower-side electromagnet 23 disappears, the elastic restoration force of the lower-side elastic member 25 being in the most compressed state displaces the armature 21 and the valve body 10 upward.

When the thus-descending valve body 10 arrives near the neutral position (zero cross point P1) as shown in FIG. 4B, the first current Ia is supplied to the coil 22*b* of the upper-side electromagnet 22 as shown in FIG. 4C. Therefore, the armature 21 is attracted upward by the electromagnetic force generated from the valve closure-side attracting surface 22*c* of the upper-side electromagnet 22. On the other hand, the elastic restoration force of the lower-side elastic member 25 disappears, but there is an inertia force acting on the armature 21 and the valve body 10 that have been ascending due to the elastic restoration force. Therefore, the resultant force of the inertia force and the attraction force due to the electromagnetic force further displaces the armature 21 and the valve body 10 upward until finally the armature 21 is attached to the valve-closing attracting surface 22*c* of the lower-side electromagnet 23 and the valve body 10 reaches the fully closed position as shown in FIG. 4B. Incidentally, the arrival of the valve body 10 at the fully closed position can be detected on the basis of the output of the lift sensor 28.

When the armature 21 is attached to the valve closure-side attracting surface 22*c* as described above, the exciting current I supplied to the coil 22*b* of the upper-side electromagnet 22 is altered to the hold current Ib that is smaller than the first current Ia as shown in FIG. 4A. Therefore, as the state where the armature 21 is attached to the valve closure-side attracting surface 22*c* is held, the valve body 10 is held at the fully closed position. At this time, the upper-side elastic member 24 assumes the most compressed state, and the lower-side elastic member 25 assumes the most expanded state.

By repeatedly performing the above-described switching actions at predetermined timing, the valve body 10 is alternately opened and closed.

Figure 5:
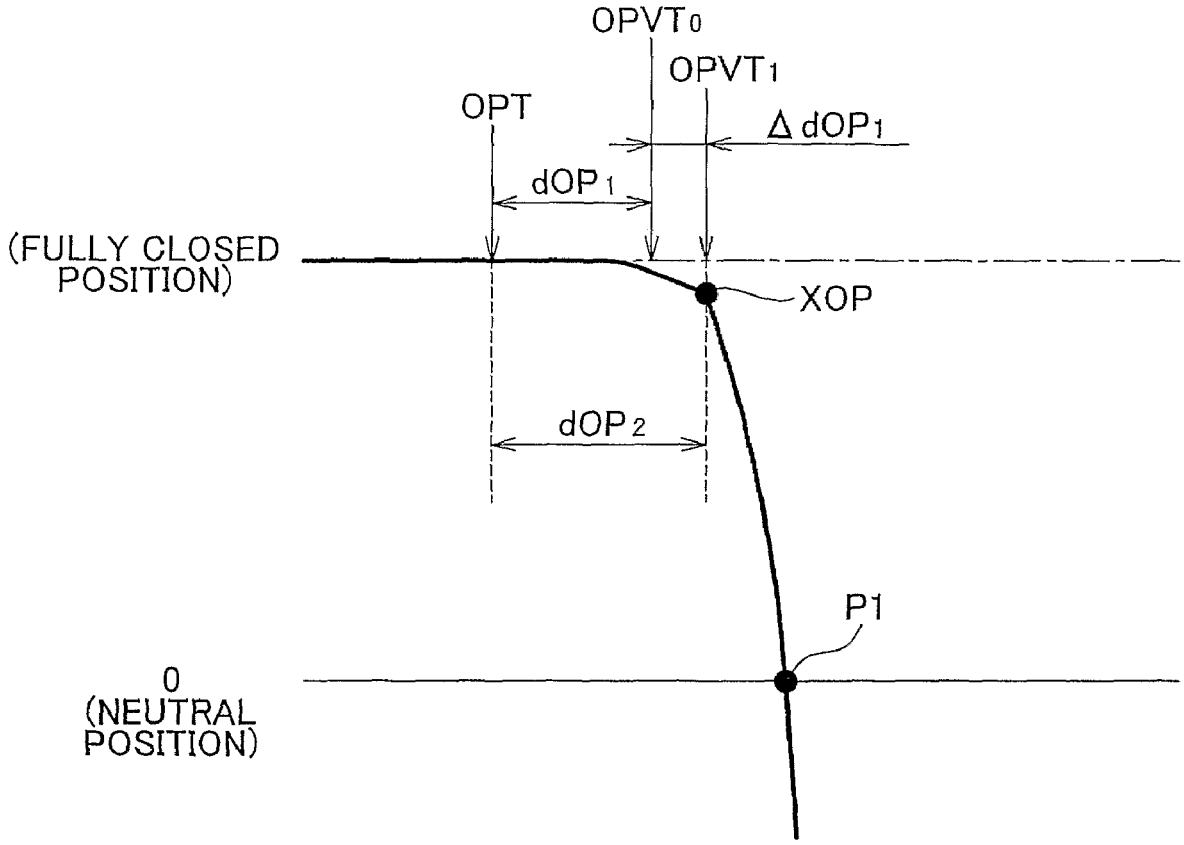
FIG. 5 is an explanatory diagram in which a region of start of valve opening in FIG. 4B is enlarged.
Figure 6:
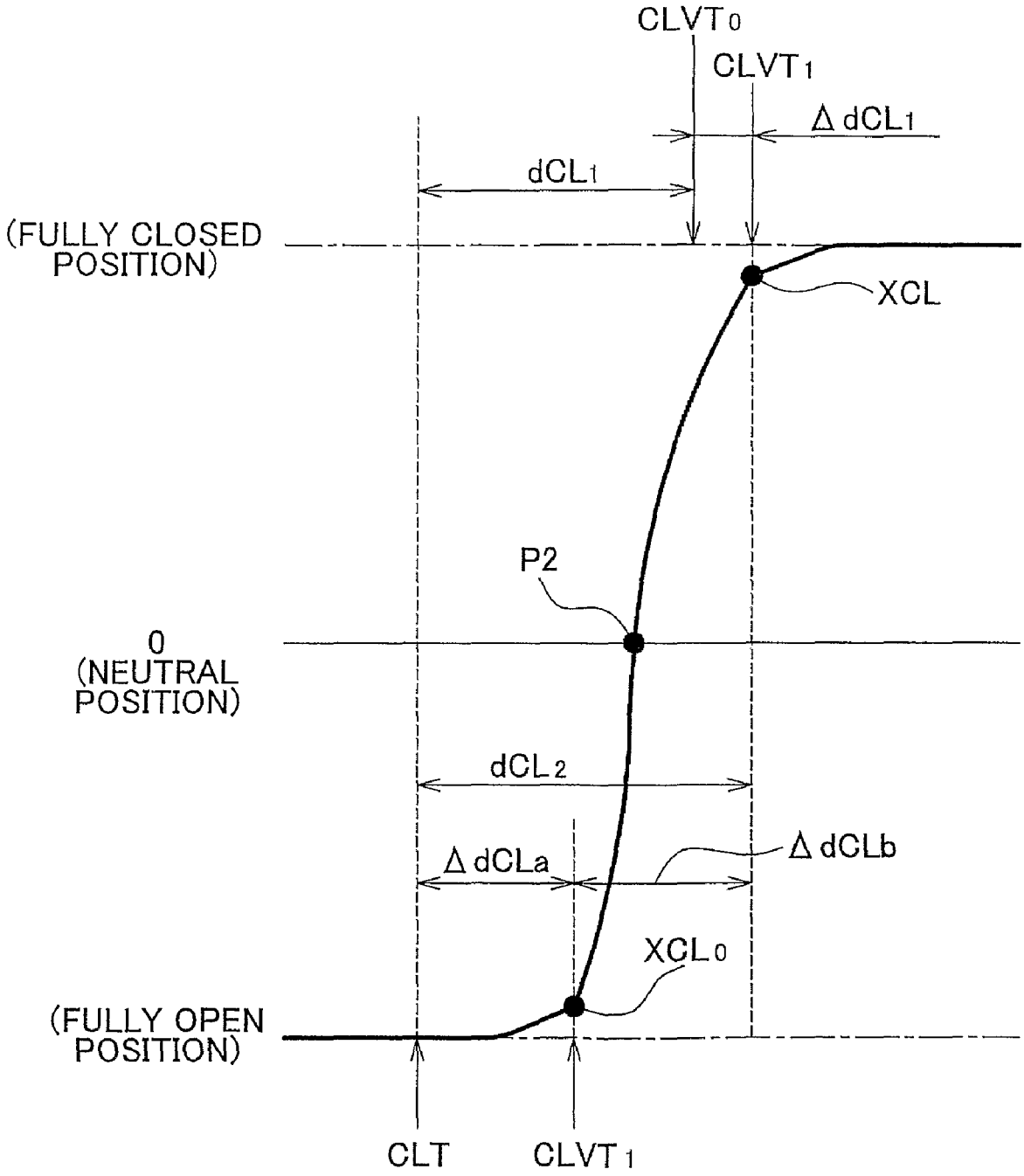
FIG. 6 is an explanatory diagram in which a valve body closure transition period from the fully open state to the fully closed state in FIG. 4B is enlarged.

Incidentally, in the valve timing control as described above, in order to restrain or prevent deviation of the actual valve timing $OPVT_1$, $CLVT_1$ relative to the target valve timings $OPVT_0$, $CLVT_0$, contrivances as described below are provided in the engine control apparatus 30 of this embodiment as described in FIGS. 5 and 6. This will be described in detail below.

In order to restrain or prevent such deviation of the valve timing, it is important to properly set command timings OPT, CLT of designating the opening/closure start positions of the valve body 10, relative to target valve timings $OPVT_0$, $CLVT_0$ acquired from the fuel supply system control apparatus 40.

In the valve timing control of this embodiment, when the target valve timings $OPVT_0$, $CLVT_0$ determined in accordance with the state of operation of the internal combustion engine are acquired, a feed forward control of setting the command timings OPT, CLT on the basis of the target valve timings $OPVT_0$, $CLVT_0$ and predetermined response delays (predicted delay times $dOP_1$, $dCL_1$) is performed. Then, a feedback control is preformed in which when the valve body 10 is opened and closed in accordance with the set command timings OPT, CLT, actual delay times $dOP_2$, $dCL_2$ needed for the displacements from the command timings OPT, CLT to the actual valve timings $OPVT_1$, $CLVT_1$ are detected, and the detected values are stored as updates of the predicted delay times $dOP_1$, $dCL_1$, for use at the time of setting the command timings OPT, CLT in the next cycle.

In addition to that, in order to raise the correctness of the values of the predicted delay times $dOP_1$, $dCL_1$, for use in the feed forward control and the values for detecting the actual delay times $dOP_2$, $dCL_2$, valve timings (opening and closure) are newly defined. At the same time, the predicted delay times $dOP_1$, $dCL_1$, for use in the feed forward control are set at the values of the sums of fixed values $dOP_0$, $dCL_0$ determined as constants empirically through experiments or the like and correction values ΔdOP, ΔdCL for correcting the fixed values.

Firstly, the definition of valve timings (opening and closure) will be described.

The opening valve timing is specified at an effective opening start position XOP that is apart from the fully closed position in correspondence to the buffer height of the lash adjuster 13. In other words, the opening start position XOP is the position of the upper-part stem 11*a* of the valve body 10 that is detected by the lift sensor 28 when the upper-part stem 11*a* of the valve body 10 descends and starts moving the lower-part stem 11*b* downward via the lash adjuster 13 after the upper-part stem 11*a* of the valve body 10 has descended and contracted the lash adjuster 13 to a predetermined length. The closing valve timing is specified at an effective closure end position XCL that is apart from the fully closed position in correspondence to the buffer height of the lash adjuster 13. In other words, the closure end position XCL is the position of the upper-part stem 11*a* of the valve body 10 that is detected by the lift sensor 28 when the bell portion 12 of the valve body 10 closes the intake port 2*a* after the lower-part stem 11*b* of the valve body 10 has ascended. The buffer height is the amount that the upper-part stem 11*a* of the valve body 10 is displaced at a constant speed relative to the fully closed position because of the lash adjuster 13. Besides, a buffer height in a cam-type valve operating mechanism buffer height may be regarded as the buffer height of the lash adjuster.

Due to this specification, the delay time at the time of opening the valve, that is, the opening delay time dOP, is a time that is needed from the opening command timing OPT, that is, the time point at which the supply of the closure hold current Ib is stopped, until the upper-part stem 11*a* of the valve body 10, after descending, actually reaches the opening start position XOP, as shown in FIG. 4B. This opening delay time dOP varies mainly due to the individual difference variations of the electromagnets 22, 23.

On the other hand, the delay time at the time of closing the valve, that is, the closure delay time dCL, is a time that is needed from the closure command timing CLT, that is, the time point at which the supply of the opening hold current Ib is stopped, until the upper-part stem 11*a* of the valve body 10, after ascending, actually reaches the closure end position XCL, as shown in FIG. 4B.

However, the closure delay time dCL is mainly the value of sum of the actuation delay time ΔdCLa from the closure command timing CLT until the closure start position $XCL_0$ is reached, and the closure transition time ΔdCLb that is needed for the valve body 10 to move from the effective closure start position $XCL_0$ to the closure end position XCL. Besides, the actuation delay time ΔdCLa until the closure start position $XCL_0$ is, in other words, a time that is needed from the closure command timing CLT until the length of the lash adjuster 13, which has been contracted, returns to a predetermined length as the lower-part stem 11*b* of the valve body 10 ascends.

Among these values, the closure transition time ΔdCLb varies because the amount of flow or the speed of a fluid (intake air, exhaust gas, or the like) that acts on the valve body differs depending on the magnitude of the load of the internal combustion engine. Therefore, the closure delay time dCL mainly includes the sum of the variation of the actuation delay time ΔdCLa and the variation of the closure transition time ΔdCLb.

In addition, the closure start position $XCL_0$ is a position that is apart from the fully open position in correspondence to the buffer height of the lash adjuster 13. The buffer height is the amount that the valve body is displaced at a constant speed relative to the fully open position because of the lash adjuster 13.

Since the opening start position XOP is defined as a specified opening valve timing and the closure end position XCL is defined as a specified closing valve timing in the above-described manner, it becomes possible to accurately discriminate the positions XOP, XCL, $XCL_0$ from noises even if the output of the lift sensor 28 is contaminated with noises.

Therefore, when the fixed values $dOP_0$, $dCL_0$ for calculating the predicted delay times $dOP_1$, $dCL_1$ are determined as constants, or when the actual delay times $dOP_2$, $dCL_2$ are measured, it is possible to eliminate the measurement error. Consequently, this results in improved correctness of the fixed values $dOP_0$, $dCL_0$ and the actual delay times $dOP_2$, $dCL_2$.

The thus-defined positions XOP, XCL, $XCL_0$ are set in the valve timing control that is executed by the engine control apparatus 30. Consequently, the setting means is realized by a function that the engine control apparatus 30 executes.

Next, the fixed values $dOP_0$, $dCL_0$ and the correction values ΔdOP, ΔdCL as the predicted delay times $dOP_1$, $dCL_1$, for use in the feed forward control are stored in the backup RAM 35. Incidentally, this backup RAM 35 realizes storage means.

Incidentally, although the initial values of the correction values ΔdOP, ΔdCL are zero, the correction values ΔdOP, ΔdCL are, after that, updated to the values of deviations $\Delta dOP_1$, $\Delta dCL_1$, of the actual valve timing $OPVT_1$, $OPVT_1$ relative to the target valve timing $OPVT_0$, $OPVT_0$.

Hereinafter, the valve timing control by the engine control apparatus 30 will be described with reference to the diagrams for explaining actions shown in FIGS. 5 and 6 and the flowcharts shown in FIGS. 7 and 8.

The valve timing control herein will be described on the assumption of a basic action based on the timing charts of FIGS. 4A, 4B and 4C. The valve timing controls shown in FIGS. 7 and 8 is executed every time a target opening valve timing $OPVT_0$ output from the fuel supply system control apparatus 40 is acquired.

<Switching Action from Fully Closed Position to Fully Open Position>

Figure 7:
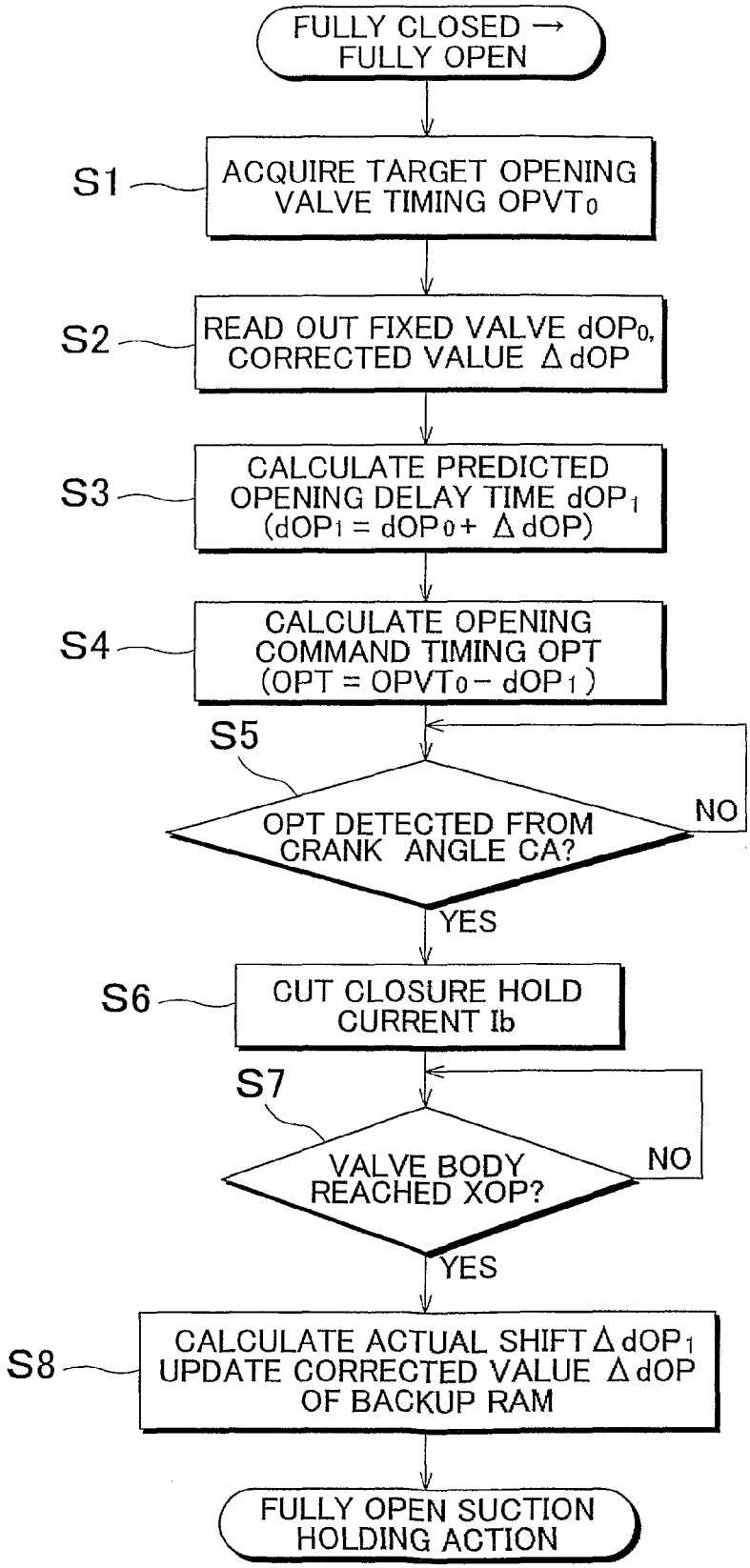
FIG. 7 is a flowchart for describing a valve timing control at the time of switching from the fully closed valve body state shown in FIG. 2 to the fully open valve body state shown in FIG. 3.

Firstly, in FIG. 7, in steps S1 to S4, a feed forward control of setting an opening command timing OPT in order to make the actual opening valve timing $OPVT_2$ equal to the target opening valve timing $OPVT_0$ is performed.

That is, in step S1, the target opening valve timing $OPVT_0$ output from the fuel supply system control apparatus 40 is acquired. In step S2, the fixed value $dOP_0$ and the correction value ΔdOP are read from the backup RAM 35.

Incidentally, the fuel supply system control apparatus 40 determines a target opening valve timing $OPVT_0$ on the basis of the rotation speed and the load of the internal combustion engine, and sends it to the engine control apparatus 30.

Subsequently in step S3, a predicted opening delay time $dOP_1$ is calculated by substituting the fixed value $dOP_0$ and the correction value ΔdOP read out in step S2 in the expression (1) below.

$$dOP_1 = dOP_0 + \Delta dOP \quad (1)$$

After that, in step S4, an opening command timing OPT is calculated by substituting the target opening valve timing $OPVT_0$ acquired in step S1 and the predicted opening delay time $dOP_1$ calculated in step S3 in the expression (2) below.

$$OPT = OPVT_0 - dOP_1 \quad (2)$$

After this operation, in step S5, detection of a crank angle CA corresponding to the opening command timing OPT calculated in step S4 on the basis of the output of the crankshaft position sensor 38 is awaited. When the crank angle CA is detected, an affirmative determination is made in step S5, and the process proceeds to step S6.

In step S6, the valve-closing drive circuit 26 is commanded to stop the supply of the closure hold current Ib to the coil 22*b* of the upper-side electromagnet 22 (opening command). Due to this, the upper-part stem 11*a* of the valve body 10 begins to be displaced downward to the fully open side.

In step S7, the arrival of the upper-part stem 11*a* of the descending valve body 10 at the opening start position XOP is awaited on the basis of the output of the lift sensor 28. When the arrival is achieved, an affirmative determination is made in step S7, and the process proceeds to step S8.

In step S8, the timing at which the upper-part stem 11*a* of the valve body 10 arrives at the opening start position XOP is recognized as an actual opening valve timing $OPVT_1$, and a deviation $\Delta dOP_1$ between the target opening valve timing $OPVT_0$ acquired in step S1 and the recognized actual opening valve timing $OPVT_1$ is calculated, and the calculated deviation $\Delta dOP_1$ is stored as an update of the correction value ΔdOP in the backup RAM 35.

Incidentally, in step S8, the actual opening valve timing $OPVT_1$ can be recognized by reading the crank angle CA that is acquired from the output of the crankshaft position sensor 38. Besides, the deviation $\Delta dOP_1$ can be determine as follows. That is, firstly, as shown in the expression (3) below, an actual opening delay time $dOP_2$ is calculated by subtracting the opening command timing OPT calculated in step S4 from the actual opening valve timing $OPVT_1$. Then, as shown in the expression (4) below, the fixed value $dOP_0$ stored in the backup RAM 35 is subtracted from the calculated actual opening delay time $dOP_2$ to determine deviation $\Delta dOP_1$.

$$dOP_2 = OPVT_1 - OPT \quad (3)$$

$$\Delta dOP_1 = dOP_2 - dOP_0 \quad (4)$$

When step S8 ends, the process proceeds to a process of performing the attracting and holding action via the lower-side electromagnet 23.

Through this process, it becomes possible to properly set the opening command timing OPT from the next cycle on. Therefore, it becomes possible to absorb the individual difference variation of the electromagnet 22, the variation of the actuation delay of the valve body 10 caused by the state of operation of the internal combustion engine, etc. Therefore, the occurrence of the deviation ΔdOP, can be restrained or prevented.

Incidentally, steps S1 to S4 are executed by command timing setting means, and steps S5 to S8 are executed by correction means.

<Switching Action from Fully Open Position to Fully Closed Position>

Figure 8:
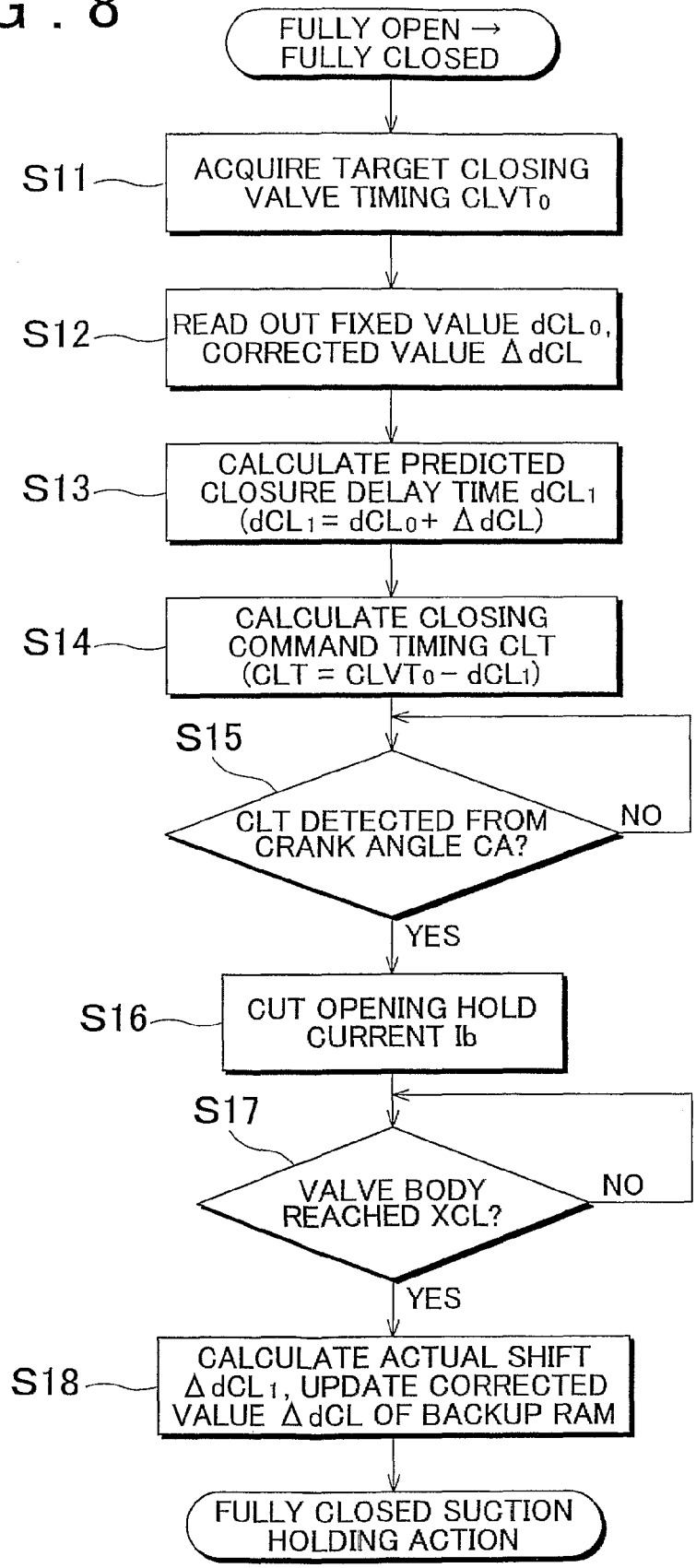

Firstly, in FIG. 8, in steps S11 to S14, a feed forward control of calculating a closure command timing CLT in order to make the actual closing valve timing $CLVT_2$ equal to the target closing valve timing $CLVT_0$.

That is, in step S11, the target closing valve timing $CLVT_0$ output from the fuel supply system control apparatus 40 is acquired. In step S12, the fixed value $dCL_0$ and the correction value ΔdCL are read out from the backup RAM 35.

Incidentally, the fuel supply system control apparatus 40 determines a target closing valve timing $CLVT_0$ on the basis of the rotation speed and the load of the internal combustion engine, and sends it to the engine control apparatus 30.

Subsequently in step S13, a predicted closure delay time $dCL_1$ is calculated by substituting the fixed value $dCL_0$ and the correction value ΔdCL read out in step S12 in the expression (5) below.

$$dCL_1=dCL_0+\Delta dCL \quad (5)$$

After that, in step S14, a closure command timing CLT is calculated by substituting the target closing valve timing $CLVT_0$ acquired in step S11 and the predicted closure delay time $dCL_1$ calculated in step S13 in the expression (6) below.

$$CLT=CLVT_0-dCL_1 \quad (6)$$

After this operation, in step S15, detection of a crank angle CA corresponding to the closure command timing CLT calculated in step S14 on the basis of the output of the crankshaft position sensor 38 is awaited. When the crank angle CA is detected, an affirmative determination is made in step S15, and the process proceeds to step S16.

In step S16, the valve-opening drive circuit 27 is commanded to stop the supply of the opening hold current Ib to the coil 23*b* of the lower-side electromagnet 23 (closure command). Due to this, the upper-part stem 11*a* of the valve body 10 begins to be displaced upward to the fully closed side.

Continuously, in step S17, the arrival of the upper-part stem 11*a* of the ascending valve body 10 at the effective closure end position XCL is awaited on the basis of the output of the lift sensor 28. When the arrival is achieved, an affirmative determination is made in step S17, and the process proceeds to step S18.

In step S18, the timing at which the upper-part stem 11*a* of the valve body 10 arrives at the closure end position XCL is recognized as an actual closing valve timing $CLVT_1$, and a deviation $\Delta dCL_1$, between the target closing valve timing $CLVT_0$ acquired in step S11 and the recognized actual closing valve timing $CLVT_1$ is calculated, and the calculated deviation $\Delta dCL_1$, is stored as an update of the correction value ΔdCL in the backup RAM 35.

Incidentally, in step S18, the actual closing valve timing $CLVT_1$ can be recognized by reading the crank angle CA output from the crankshaft position sensor 38. Besides, the deviation $\Delta dCL_1$, can be determined as follows. That is, firstly, as shown in the expression (7) below, an actual closure delay time $dCL_2$ is calculated by subtracting the closure command timing CLT calculated in step S14 from the actual closure valve timing $CLVT_1$. Then, as shown in the expression (8) below, the fixed value $dCL_0$ stored in the backup RAM 35 is subtracted from the actual closure delay time $dCL_2$ to determine deviation $\Delta dCL_1$.

$$dCL_2=CLVT_1-CLT \quad (7)$$

$$\Delta dCL_1=dCL_2-dCL_0 \quad (8)$$

When step S18 ends, the process proceeds to a process of performing the attracting and holding action via the upper-side electromagnet 22.

Through this process, it becomes possible to properly set the closure command timing CLT from the next cycle on. Therefore, it becomes possible to absorb the individual difference variation of the lower-side electromagnet 23, the variation of the closure transition time ΔdCLb of the valve body 10 caused by the state of operation of the internal combustion engine, etc. Therefore, the occurrence of the deviation $\Delta dCL_1$, of the actual valve timing $CLVT_1$ can be restrained or prevented.

Incidentally, steps S11 to S14 are executed by command timing setting means, and steps S15 to S18 are executed by correction means.

As described above, in the valve timing control of this embodiment, in short, the valve timings (opening, closure) are specified at the effective opening start position XOP and the effective closure end position XCL that are accurately detectable by the lift sensor 28 or the like. Therefore, when the deviations $\Delta dOP_1$, $\Delta dCL_1$, of the actual valve timings $OPVT_1$, $CLVT_1$ relative to the target valve timings $OPVT_0$, $CLVT_0$ are to be determined, or at the time of measurement by the lift sensor 28 or the like in an experimental stage for determining as constants the fixed values $dOP_0$, $dCL_0$ to be stored in the backup RAM 35, the measurement end timing can be accurately specified.

Besides, since it becomes possible to accurately detect the actual valve timings $OPVT_1$, $CLVT_1$, it becomes less likely that measurement errors will be included in the deviations $\Delta dOP_1$, $\Delta dCL_1$, and the fixed values $dOP_0$, $dCL_0$.

Furthermore, since the actual deviations $\Delta dOP_1$, $\Delta dCL_1$ acquired in the previous cycle are successively stored as updates of the correction values ΔdOP, ΔdCL in the backup RAM 35, the correctness of the predicted delay times $dOP_1$, $dCL_1$, for use at the time of setting the command timings OPT, CLT improves, and advantage is achieved in the proper setting of the command timings OPT, CLT.

Due to these features and the like, it becomes possible to restrain or prevent the deviations $\Delta dOP_1$, $\Delta dCL_1$, of the actual valve timings $OPVT_1$, $CLVT_1$ relative to the target valve timings $OPVT_0$, $CLVT_0$ in an early stage from the startup of the internal combustion engine. In other words, at the time of opening the valve, the individual difference variation of the electromagnet 22 can be absorbed. At the time of closing the valve, the sum of the individual difference variation of the lower-side electromagnet 23 and the variation of the closure transition time ΔdCLb of the valve body 10 caused by the state of operation of the internal combustion engine can be absorbed.

Consequently, the combustion condition of the internal combustion engine can be brought into a proper range promptly after the engine is started. Hence, it becomes possible to restrain or prevent torque fluctuations of the internal combustion engine.

Hereinafter, other embodiments will be described.

(1) Although in the foregoing embodiment, the actual deviations $\Delta dOP_1$, $\Delta dCL_1$, of the valve timings acquired in the previous cycle are stored as updates of the correction values ΔdOP, ΔdCL in the backup RAM 35, this is not restrictive. For example, the actual delay times $dOP_2$, $dCL_2$ acquired in the previous cycle may be stored as updates of the fixed values $dOP_0$, $dCL_0$ in the backup RAM 35.

In this case, the fixed values $dOP_0$, $dCL_0$ alone are saved as predicted delay times $dOP_1$, $dCL_1$, in the backup RAM 35, and the correction values ΔdOP, ΔdCL are not saved.

This makes it possible to omit the process of calculating the actual deviations $\Delta dOP_1$, $\Delta dCL_1$, by subtracting the fixed values $dOP_0$, $dCL_0$ from the actual delay times $dOP_2$, $dCL_2$ and the process of saving the deviations $\Delta dOP_1$, $\Delta dCL_1$, as updates of the correction values ΔdOP, ΔdCL stored in the backup RAM 35 in step S8 of FIG. 7 and step S18 of FIG. 8, and thus allows improvement of the processing speed.

(2) Although the foregoing embodiment is described in conjunction with an example case of the valve timing control of a single valve body 10, this is not restrictive. For example, in the case where the number of intake valves used or the number of exhaust valves used for a cylinder is more than one, or in the case of an electromagnetic drive valve operating mechanism 1 installed in a multicylinder internal combustion engine or the like, the valve timing control of the valve bodies may be performed individually for each valve body, and the valve timing control of each valve body may be substantially the same as the valve timing control of the embodiment.

In this case, the fixed values and the correction values as predicted delay times corresponding to each valve body are stored individually in the backup RAM 35. Then, at the time of setting the command timing for each valve body, the fixed values and the correction values corresponding to each valve body are used to perform the feed forward control individually. Furthermore, the deviations of the actual valve timings relative to the target valve timings for each valve body are detected individually, and the values of deviation for each valve body are individually stored as updates of correction values in the backup RAM 35.

This makes it possible, in an electromagnetic drive valve operating mechanism equipped with a plurality of valve bodies, to absorb all the individual difference variations of the electromagnets provided as drive portions of the individual valve bodies, and to make the valve timing proper individually for each valve body in an early stage from the startup of the internal combustion engine. In particular, in a multicylinder internal combustion engine, this feature, for example, makes it possible to bring the combustion condition of each cylinder into a proper range, and thus is advantageous in restraining or preventing the torque fluctuations of the multicylinder internal combustion engine.

(3) In the embodiment, the predicted delay times $dOP_1$, $dCL_1$, calculated in step S3 of FIG. 7 or step S13 of FIG. 8 may be accumulated in an opening delay time map (e.g., see Table 1) or a closure delay time map (e.g., see Table 2) in which the rotation speed NE and the load KL of the internal combustion engine are used as parameters.

Figure 9:
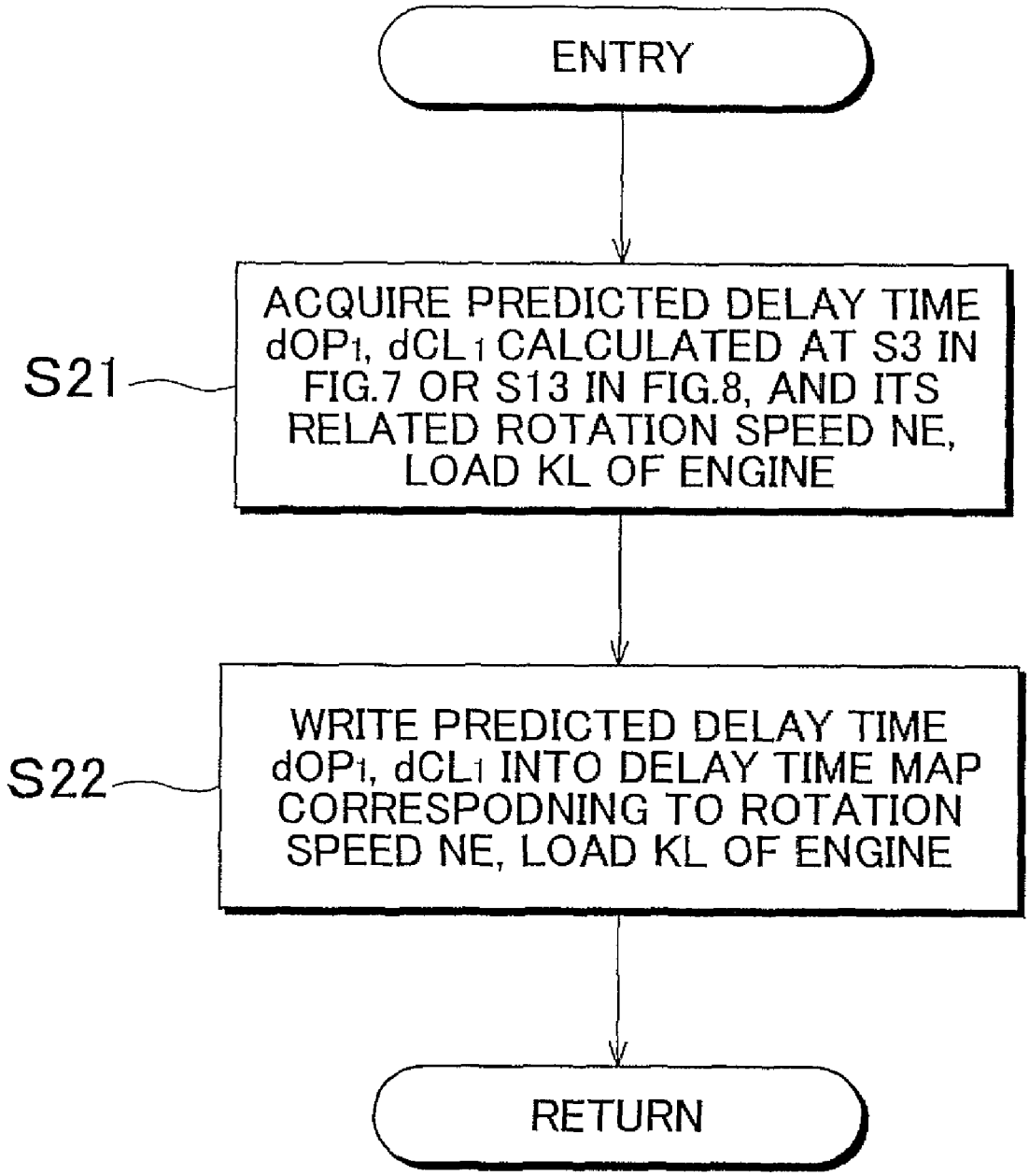
FIG. 9 is a flowchart for describing a valve timing control at the time of switching from the fully open valve body state shown in FIG. 3 to the fully closed valve body state shown in FIG. 2.

FIG. 9 is a flowchart for describing a delay time map creating routine. This creating routine is entered in parallel with the process of the flowchart shown in FIG. 7 or 8 when predicted delay times $dOP_1$, $dCL_1$, are calculated in step S3 of FIG. 7 or step S13 of FIG. 8.

Specifically, in step S21, the predicted delay times $dOP_1$, $dCL_1$, calculated in step S3 of FIG. 7 or step S13 of FIG. 8 are temporarily saved in a buffer region of the RAM 34, and the rotation speed NE and the load KL of the internal combustion engine related to the target valve timings $OPVT_0$, $CLVT_0$ acquired in step S1 of FIG. 7 or step S11 of FIG. 8 are acquired from the fuel supply system control apparatus 40. In step S22, the predicted delay times $dOP_1$, $dCL_1$ are stored in a region of the map that corresponds to the acquired rotation speed NE and the acquired load KL of the internal combustion engine.

Incidentally, the rotation speed NE of the internal combustion engine can be acquired, for example, on the basis of the output signals of a rotation speed sensor provided for the internal combustion engine. Besides, the load KL of the internal combustion engine can be determined, for example, by acquiring the intake air amount GN, the throttle opening degree TA, etc. on the basis of the output signals of an air flow meter, a throttle sensor, etc. provided for the internal combustion engine, and by using the thus-acquired information as a basis for determining the load KL.

TABLE 1

Opening delay time map (μsec)

| | Internal combustion engine rotation speed (rpm) | | | | |
|---|---|---|---|---|---|
| Internal combustion engine load (KL) | 1000 | 2000 | 3000 | 4000 | 5000 |
| 20 | 400 | 410 | 420 | 430 | 440 |
| 40 | 410 | 420 | 430 | 440 | 450 |
| 60 | 410 | 420 | 430 | 440 | 450 |
| 80 | 410 | 420 | 430 | 440 | 450 |
| 100 | 410 | 420 | 430 | 440 | 450 |

TABLE 2

Closure delay time map (μsec)

| | Internal combustion engine rotation speed (rpm) | | | | |
|---|---|---|---|---|---|
| Internal combustion engine load (KL) | 1000 | 2000 | 3000 | 4000 | 5000 |
| 20 | 3000 | 3100 | 3200 | 3300 | 3400 |
| 40 | 3100 | 3200 | 3300 | 3400 | 3500 |
| 60 | 3200 | 3300 | 3400 | 3500 | 3600 |
| 80 | 3300 | 3400 | 3500 | 3600 | 3700 |
| 100 | 3400 | 3500 | 3600 | 3700 | 3800 |

The numerical values appearing in the delay time maps of Tables 1 and 2 are not values that were actually acquired in a specific condition, but are values that merely indicate the tendencies of magnitude changes of the numerical values.

Then, the predicted delay times $dOP_1$, $dCL_1$, written into the delay time maps can be learned by updating them with values that are successively acquired at a constant period (e.g., every cycle or every constant number of cycles) during one trip period from a startup of operation of the internal combustion engine to the stop thereof.

The learned values of the predicted delay times $dOP_1$, $dCL_1$, written in the delay time maps may be utilized, for example, during the next trip period, as, for example, the fixed values $dOP_0$, $dCL_0$ to be used in the computation in step S3 of FIG. 7 or step S13 of FIG. 8.

Figure 10:
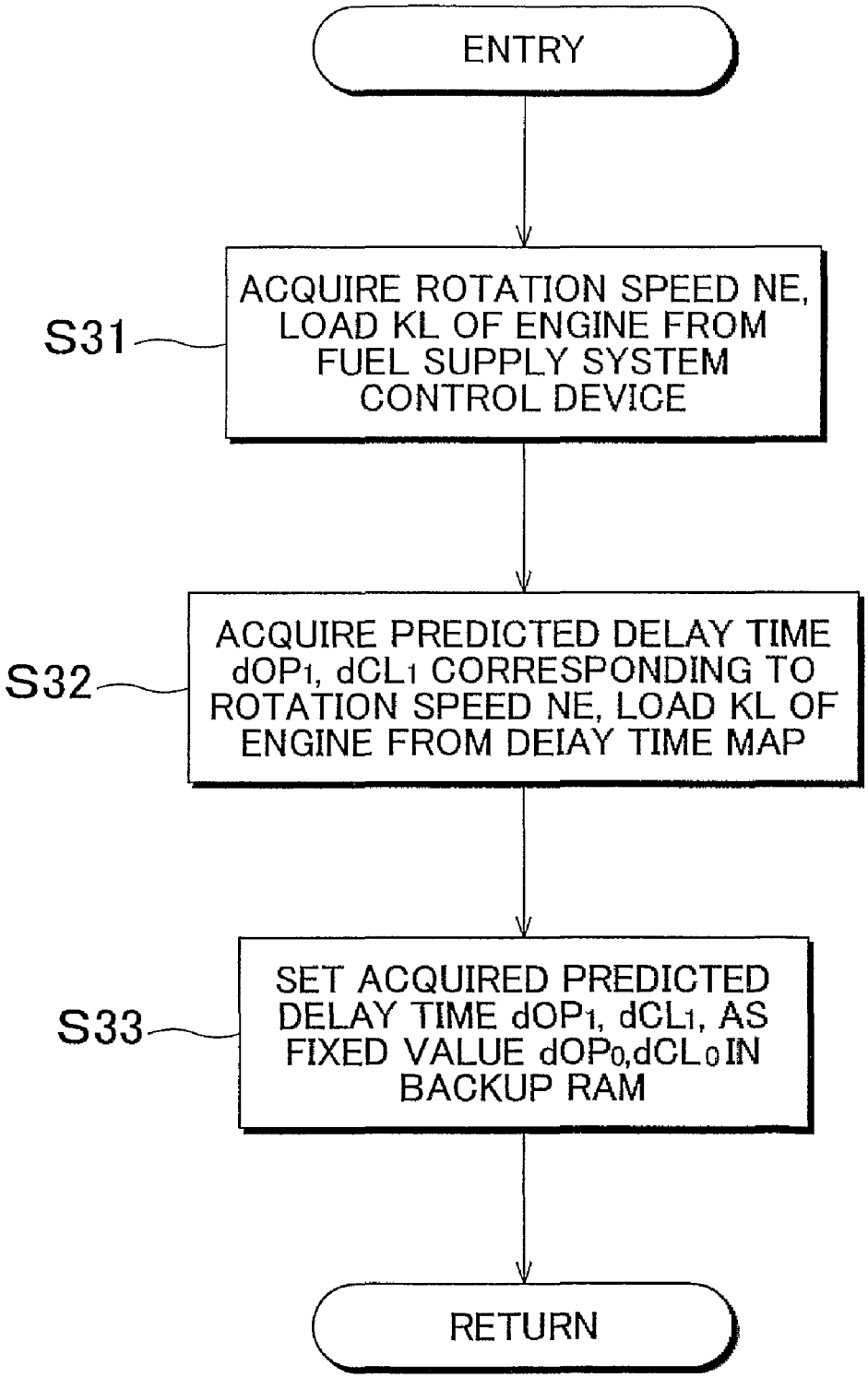
FIG. 10 is a flowchart for describing a delay time map managing routine in the valve timing control in the embodiment shown in FIG. 9.

FIG. 10 is a flowchart for describing a delay time map managing routine in the valve timing control. This managing routine is entered in parallel with the routine of the flowchart shown in FIG. 7 or 8, for example, when in step S1 of FIG. 7 or step S11 of FIG. 8, the target valve timings $OPVT_0$, $CLVT_0$ sent from the fuel supply system control apparatus 40 are acquired.

Firstly, in step S31, the rotation speed NE and the load KL of the internal combustion engine related to the acquired target valve timings $OPVT_0$, $CLVT_0$ are acquired from the fuel supply system control apparatus 40. In step S32, pertinent predicted delay times $dOP_1$, $dCL_1$, are read out on the basis of the delay time maps. The read-out predicted delay times $dOP_1$, $dCL_1$, are set as fixed values $dOP_0$, $dCL_0$ in the backup RAM 35 in step S33. Then, this routine is exited.

Therefore, it becomes possible that the fixed values $dOP_0$, $dCL_0$ set in the backup RAM 35 in step S33 can be utilized as initial values of fixed values $dOP_0$, $dCL_0$ for use in the computation in step S3 of FIG. 7 or in step S13 of FIG. 8.

According to the embodiments described above, it becomes possible to shorten the times of convergence of the valve timing deviations in each region corresponding to the fluctuations in the actual delay times $dOP_2$, $dCL_2$ in accordance with the fluctuations in the rotation speed NE and the load KL of the internal combustion engine. Therefore, it becomes possible to restrain or prevent deterioration of emissions or fuel economy, or decline of torque, etc.

Furthermore, in the case of an electromagnetic drive valve operating mechanism that has a plurality of valve bodies as described above in the paragraph (2), the delay time maps as described above can be obtained for each one of the valve bodies. In that case, it becomes possible to absorb all the individual difference variations of all the individual valves, and therefore make the valve timings proper individually for each valve body in an early stage from the startup of the internal combustion engine.

(4) In the electromagnetic drive valve operating mechanism 1 having a plurality of valve bodies as described above in the paragraph (3), the presence/absence of an action abnormality of each valve body can be diagnosed. This abnormality diagnosis is performed by utilizing a self-diagnostic program (diagnosis function, or the like) stored in the ROM 33 of the engine control apparatus 30. Generally, the diagnosis function is to always check whether the system or the signal system of the internal combustion engine is normally operating, by inputting various sensor signals. If an abnormality occurs, the system where the abnormality has occurred is stored in memory. By reading out such stored information, abnormality diagnosis can easily be performed.

Figure 11:
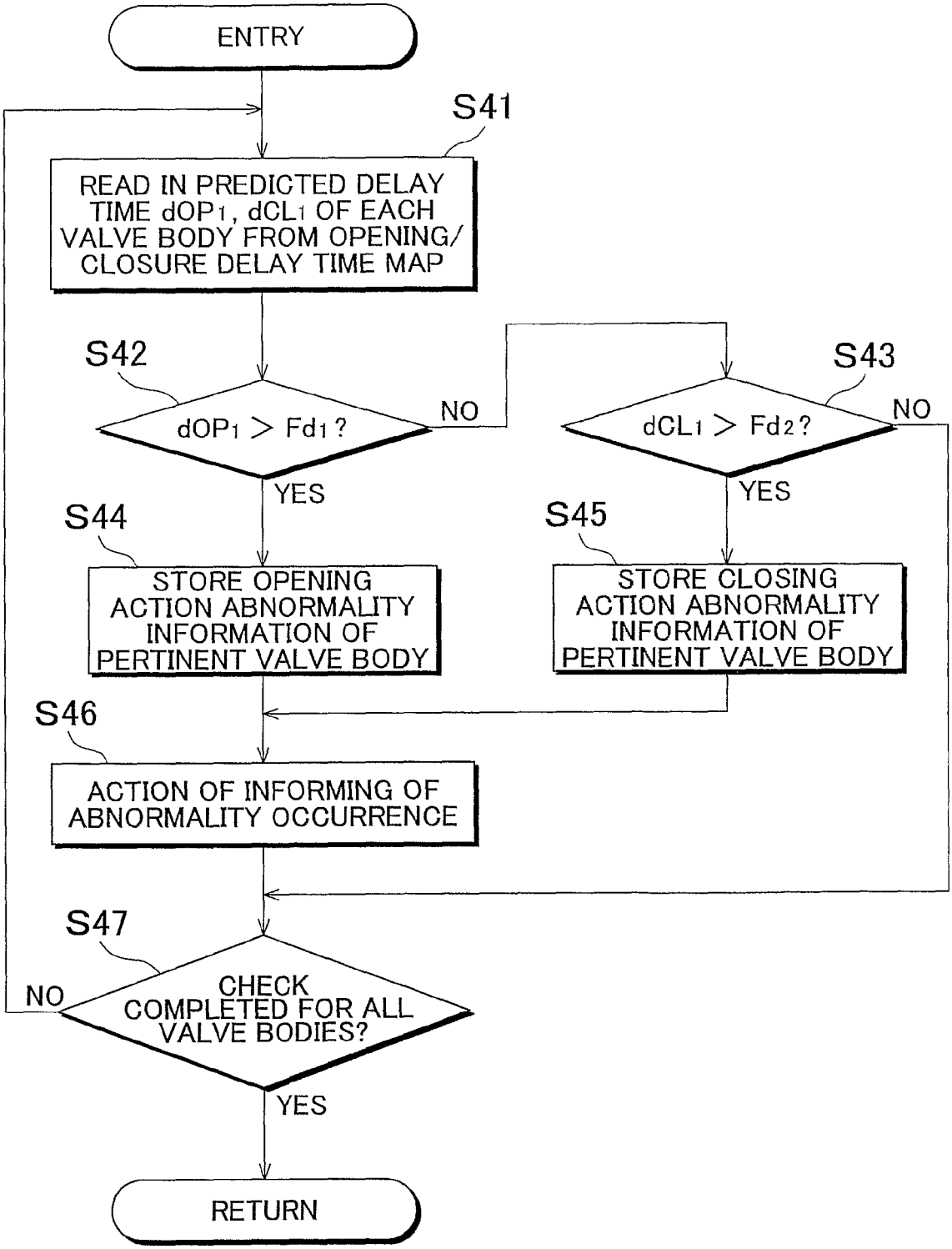
FIG. 11 is a flowchart for describing an abnormality diagnosis routine of the electromagnetic drive valve operating mechanism in still another embodiment of the control apparatus in accordance with the invention.

FIG. 11 is a flowchart for describing an abnormality diagnosis routine of the electromagnetic drive valve operating mechanism 1. This abnormality diagnosis routine is repeatedly executed at a constant period (e.g., every cycle or every constant number of cycles) during one trip period.

In this abnormality diagnosis, the presence/absence of abnormality is checked by determining whether many learned values of predicted delay times $dOP_1$, $dCL_1$ regarding each valve body stored in the opening delay time map shown in Table 1 and the closure delay time map shown in Table 2 described above in the paragraph (3) are greater than a corresponding one of predetermined threshold values $Fd_1$, $Fd_2$ determined as constant empirically through experiments beforehand, respectively.

Specifically, in step S41, many learned values of predicted delay times $dOP_1$, $dCL_1$, regarding each valve body stored in the opening delay time map shown in Table 1 and the closure delay time map shown in Table 2 are individually read in, respectively, and in step S42, it is determined whether or not the read learned value of opening delay time $dOP_1$ is greater than the threshold value $Fd_1$. Herein, if the learned value of opening delay time $dOP_1$ is smaller than the threshold value $Fd_1$, it can be estimated that no abnormality has occurred, and therefore, in step S42, a negative determination is made, and the process proceeds to step S43. If the learned value of opening delay time $dOP_1$ is larger than the threshold value $Fd_1$, it can be estimated that an abnormality has occurred, and therefore, in step S42, an affirmative determination is made, and the process proceeds to step S44.

In step S43, it is determined whether or not the read learned value of the predicted closure delay time $dCL_1$, is greater than the threshold value $Fd_2$. If it is greater than the threshold value $Fd_2$, it can be estimated that an abnormality has occurred, and therefore, an affirmative determination is made, and the process proceeds to step S45. If the learned value of the predicted closure delay time $dCL_1$, is smaller than the threshold value $Fd_2$, it can be estimated that no abnormality has occurred, and therefore, a negative determination is made, and the process proceeds to step S47.

In step S44, information that there is an abnormality in the opening action of the valve body pertinent to the learned value of the predicted opening delay time $dOP_1$ acquired in step S41 is, for example, written into a storage region of the backup RAM 35 related to the diagnosis function. After the occurrence of abnormality is informed of in step S37, the process proceeds to step S47.

In step S45, information that there is an abnormality in the closing action of the valve body pertinent to the learned value of the predicted closure delay time $dCL_1$, acquired in step S41 is, for example, written into a storage region of the backup RAM 35 related to the diagnosis function. After the occurrence of abnormality is informed of in step S46, the process proceeds to step S47.

The action of informing of the occurrence of abnormality may be, for example, of a form in which an internal combustion engine check lamp mounted in or around a meter panel on the driver's seat side is turned on, or a form in which character information for prompting the driver to check the internal combustion engine is displayed if an image display device is provided, and may also be of other forms.

Then, in step S47, it is determined whether or not the abnormality determination has been executed on all the learned values of the predicted delay times $dOP_1$, $dCL_1$, regarding all the valve bodies which are stored in the opening delay time map shown in Table 1 and the closure delay time map shown in Table 2. If the determination has been executed on all the learned values, the abnormality diagnosis routine is ended. If the determination has not been executed on all the learned values, the process returns to step S41, and the above-described process is repeated.

Thus, on the assumption of the electromagnetic drive valve operating mechanism 1 having a plurality of valve bodies, the presence/absence of occurrence of abnormality is estimated on all the valve bodies. Therefore, the driver can be informed of the presence of an abnormality before a critical failure occurs, so that an abnormality can be dealt with in an early stage, for example, by checking, repair, or the like. This feature is preferable.

Furthermore, it is not that information is acquired specifically for the abnormality diagnosis, but the predicted delay times accumulated as the delay time maps in the valve timing control of the electromagnetic drive valve operating mechanism 1 are used to perform the abnormality diagnosis. Therefore, this feature is advantageous in that unessential cost increase can be restrained.

(5) Although the embodiments have been described in conjunction with the electromagnetic drive valve operating mechanism 1 of a translational drive type, this is not restrictive. For example, an electromagnetic drive valve operating mechanism of a pivot drive type is also an object of application of the control apparatus in accordance with the invention.

Such a pivot drive type electromagnetic drive valve operating mechanism has a structure in which a drive portion 20 is disposed at a side of a valve body 10, as shown in, for example, the specification attached to Japanese Patent Application No. 2004-257593, the specification of U.S. Pat. No. 6,467,441, etc.

Incidentally, the translational drive type of electromagnetic drive valve operating mechanism is a mechanism having a construction in which the armature is coaxially fixed to a valve body, and two electromagnetic attracting surfaces are provided on opposite sides of the armature in the direction of the axis. On the other hand, the pivot drive type of electromagnetic drive valve operating mechanism is a mechanism having a construction in which a tilting member is provided at a side of a valve body, and the tilting member is tilted by electromagnetic force to displace the valve body in the direction of the axis. Besides, although in either type, there are a construction in which two electromagnets are used, and a construction in which one mono-coil type electromagnet is used, the invention is applicable to all the electromagnetic drive valve operating mechanisms.

The invention claimed is:

1. A control apparatus of an electromagnetic drive valve operating mechanism that opens and closes a valve body used as an intake valve or an exhaust valve of an internal combustion engine through coordination of electromagnetic force and elastic force, comprising:

a setting device that determines an opening valve timing and a closing valve timing based on a buffer height of a buffer mechanism of the valve body, the opening valve timing being a first timing at which the valve body reaches a first position at which the valve body starts to open, the closing valve timing being a second timing at which the valve body reaches a second position at which the valve body is substantially completed closing, wherein both the first valve timing and the second valve timing are distinct from a timing at which the valve body is in a fully closed position; and a calculating device that calculates a first predicted delay time based on the opening valve timing and a second predicted delay time based on the closing valve timing, the first predicted delay time being a first amount of time that is needed for the valve body to be displaced during an opening operation to a first target valve timing, the second predicted delay time being a second amount of time that is needed for the valve body to be displaced during a closing operation to a second target valve timing, wherein the electromagnetic drive valve operating mechanism is controlled based on the first predicted time delay and the second predicted time delay.

2. The control apparatus according to claim 1, wherein the buffer mechanism is located on a stem of the valve body.

3. The control apparatus according to claim 1, wherein the valve body includes an upper-part stem including an armature that is pulled by the electromagnetic force, a lower-part stem provided downward from the upper-part stem in a direction of opening/closing action of the valve body, and wherein the buffer mechanism is provided between the upper-part stem and the lower-part stem.

4. The control apparatus according to claim 1, wherein the buffer height is a value determined on a basis of an amount that the valve body is displaced at a constant speed relative to the fully closed position because of the buffer mechanism.

* * * * *

UNITED STATES PATENT AND TRADEMARK OFFICE

CERTIFICATE OF CORRECTION

PATENT NO. : 7,944,671 B2
APPLICATION NO. : 12/089259
DATED : May 17, 2011
INVENTOR(S) : Hideyuki Nishida et al.

It is certified that error appears in the above-identified patent and that said Letters Patent is hereby corrected as shown below:

On the title page, Item (87), the PCT Pub. No. is incorrect. Item (87) should read:

-- (87) PCT Pub. No.: WO2007/039813
PCT Pub. Date: Apr. 12, 2007 --

Signed and Sealed this
Twelfth Day of July, 2011

David J. Kappos

David J. Kappos
*Director of the United States Patent and Trademark Office*